US009039098B2

(12) United States Patent
Fanslow

(10) Patent No.: US 9,039,098 B2
(45) Date of Patent: May 26, 2015

(54) SKID STEER SLAB CUTTING ATTACHMENT

(71) Applicant: Safety Technologies, Inc., Red Wing, MN (US)

(72) Inventor: Charles E. Fanslow, Red Wing, MN (US)

( * ) Notice: Subject to any disclaimer, the term of this patent is extended or adjusted under 35 U.S.C. 154(b) by 0 days.

(21) Appl. No.: 13/743,446

(22) Filed: Jan. 17, 2013

(65) Prior Publication Data

US 2014/0197673 A1 Jul. 17, 2014

(51) Int. Cl.
*E01C 23/09* (2006.01)
*B27B 5/10* (2006.01)
*B28D 1/18* (2006.01)

(52) U.S. Cl.
CPC ..... *E01C 23/09* (2013.01); *B28D 1/181* (2013.01); *E01C 23/0933* (2013.01); *B27B 5/10* (2013.01); *E01C 2301/50* (2013.01)

(58) Field of Classification Search
CPC . E01C 23/0933; E01C 2301/50; E01C 23/09; B27B 5/10; B28D 1/181
USPC ..... 299/39.3, 39.9, 40.1, 39.2, 39.4, 73, 75, 299/76, 78
See application file for complete search history.

(56) References Cited

U.S. PATENT DOCUMENTS

| | | | | | |
|---|---|---|---|---|---|
| 2,664,281 | A | * | 12/1953 | Luksch et al. | 299/37.3 |
| 3,472,554 | A | * | 10/1969 | Hopkins | 299/40.1 |
| 4,175,788 | A | | 11/1979 | Jacobson et al. | |
| 4,204,714 | A | | 5/1980 | Jacobson et al. | |
| 4,275,928 | A | * | 6/1981 | Jackson | 299/39.9 |
| 4,572,580 | A | | 2/1986 | Bieri | |
| 4,748,966 | A | | 6/1988 | Kennedy | |
| 4,832,412 | A | | 5/1989 | Bertrand | |
| 5,382,084 | A | * | 1/1995 | Diver et al. | 299/39.5 |
| 5,724,956 | A | | 3/1998 | Ketterhagen | |
| 5,857,453 | A | | 1/1999 | Caven et al. | |
| 6,102,022 | A | | 8/2000 | Schave | |
| 6,135,567 | A | * | 10/2000 | Cochran | 299/39.6 |
| 6,171,017 | B1 | | 1/2001 | Watkins | |
| 6,203,112 | B1 | | 3/2001 | Cook et al. | |
| 6,247,757 | B1 | * | 6/2001 | Cochran | 299/39.6 |
| 6,321,738 | B1 | * | 11/2001 | Walsh | 125/15 |
| 6,422,228 | B1 | | 7/2002 | Latham | |
| 6,470,874 | B1 | | 10/2002 | Mertes | |
| 2005/0016517 | A1 | * | 1/2005 | Perry | 125/13.01 |
| 2008/0017182 | A1 | | 1/2008 | Hilsgen | |

FOREIGN PATENT DOCUMENTS

| | | | |
|---|---|---|---|
| GB | 2468785 | A * | 9/2010 |
| WO | 0198045 | | 12/2001 |

OTHER PUBLICATIONS

Marathon Equipment, Inc., "Crack Router", http://www.marathonequipmentinc.com/PCR.html (last visited Dec. 12, 2012).

* cited by examiner

*Primary Examiner* — David Bagnell
*Assistant Examiner* — Michael Goodwin
(74) *Attorney, Agent, or Firm* — Haugen Law Firm PLLP

(57) ABSTRACT

A cutting apparatus is described, capable of cutting hard materials including asphalt and concrete. The cutting apparatus is particularly well suited for attachment to a skid steer or other transportation implement. When attached to a skid steer the apparatus includes a frame that allows the cutting system to slide from side to side, slide up and down, or rotate about a vertical axis while held in a cutting position by the skid steer boom. The cutting apparatus also includes an airflow member that affectively creates an air turbulence to thereby confine debris and dust within a shroud and to direct the debris and dust against a surface of the shroud to a localized exit at a minimized velocity.

19 Claims, 15 Drawing Sheets

SKID STEER SLAB CUTTING ATTACHMENT

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to a cutting system for cutting hard materials. More particularly, the invention pertains to a cutting system capable of cutting through thick layers of concrete or asphalt and capable of cutting along a crooked crack line in concrete or asphalt layer. The cutting system of the invention is also capable of attachment to a transport implement including a skid steer.

BACKGROUND

Generally, traditional roadway surfaces include a relatively hard top layer made of asphalt or concrete. Over time, the roadway may develop potholes, become cracked, or otherwise be in need of repair. A number of approaches have been implemented to repair a roadway. Many of these approaches require cutting out sections of the roadway or cutting along the crack lines to separate portions of the roadway material. Prior hand held and walk behind saws have been described that saw asphalt and concrete, however, many of these saws discharge randomly air-born particulate and debris. Also, the direction that the saw blade rotates may require significant forces to hold the saw in a sawing position and may create undesirable kickback or uncontrolled self-propulsion.

Further, although skid steer attachments have provided an alternative to many walk behind and other cumbersome manual machinery, precise guidance and steering of rotating attachments remains subjectively problematic. Also, visibility of many moving parts may be obscured from view making precise alignment difficult.

SUMMARY

Embodiments according to aspects of the invention are capable of cutting through hard materials including roadways constructed of concrete and asphalt. According to other aspects, the invention is capable of self-aligning a cutting system while cutting along a crack in a roadway. The invention also reduces the velocity of discharged particulate and attaches to a skid steer or other transport implement in an uncomplicated manner.

These and other embodiments according to aspects of the invention include a cutting system having an airflow generating member and a shroud. The cutting system includes a motor, a drive spindle coupled to the motor, and a cutting assembly coupled to the drive spindle. The cutting assembly may have, for example, a circular blade with diamond tipped cutting teeth. Alternatively, the cutting assembly may have, for example, multiple cutters that rotate on independent spindles that are aligned concentric to the drive spindle. The airflow generating member is coupled to the cutting system and the shroud surrounds at least a portion of the cutting assembly to direct cutting debris behind a downward travel of each cutter. The shroud may include a curvature that simulates a portion of a logarithmic spiral surface. As debris is directed against and contacts the spiral surface the velocity of the particulate dust and debris decreases, whereupon, the dust and debris exits the shroud towards the ground at relatively low velocities.

A frame and mount couples the cutting system to a transport implement. The frame includes structures attached in a way to the cutting system and the transport implement so that the cutting system effectively floats but remains contained by the frame. The floating of the cutting system allows the cutting assembly to both rotate and slide linearly up and down to thereby cut within a crack line at a consistent depth along uneven roadways. The frame structure also includes a self-centering linear travel stop for the cutter system. The cutter system is coupled to the frame in a manner so that a vertical axis of the portion of the frame coupled to the cutting system is offset from a rotational axis of the cutting assembly.

Another embodiment according to aspects of the invention includes a concrete cutting apparatus having a cutting system, an airflow generating member, a frame having a rigid portion and a floating portion, and a shroud surrounding at least a portion of the cutting system. The cutting system has a motor, drive spindle and cutter assembly coupled together and engaged to the frame. A discharge chute of the shroud directs cutting debris behind a downward travel of a cutter of the cutter assembly. The floating portion of the frame is coupled to the cutting system forward of a rotational axis of the cutter assembly. The floating portion of the frame may include first and second tubular columns wherein an end of the first tubular column is coupled to the rigid portion of the frame. The second tubular column portion rotates about a longitudinal axis within the first tubular column and an end is coupled to cutting system. The other end of the second tubular column includes a stop ring that engages with a self-centering linear travel stop attached to the first tubular column. The second tubular column may rotate and slide between and up and down position allowing the cutting system to follow a curving path of a crack and the ups and downs of uneven pavement.

Another embodiment according to aspects of the invention includes a concrete cutting apparatus having a cutting system, an airflow generating member coupled to the cutting system, a frame having a rigid portion and a floating portion, and a shroud. The floating portion of the frame is coupled to the cutting system and the rigid portion of the frame is coupled to a mount that couples the frame to a transport implement. The shroud surrounds at least a portion of the cutter assembly to direct cutting debris behind a downward travel of the cutting assembly. The floating portion rotates and slides linearly relative to the rigid frame portion and a travel stop defines the length of travel that the cutter system may travel up and down without changing the relative position of the rigid frame.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
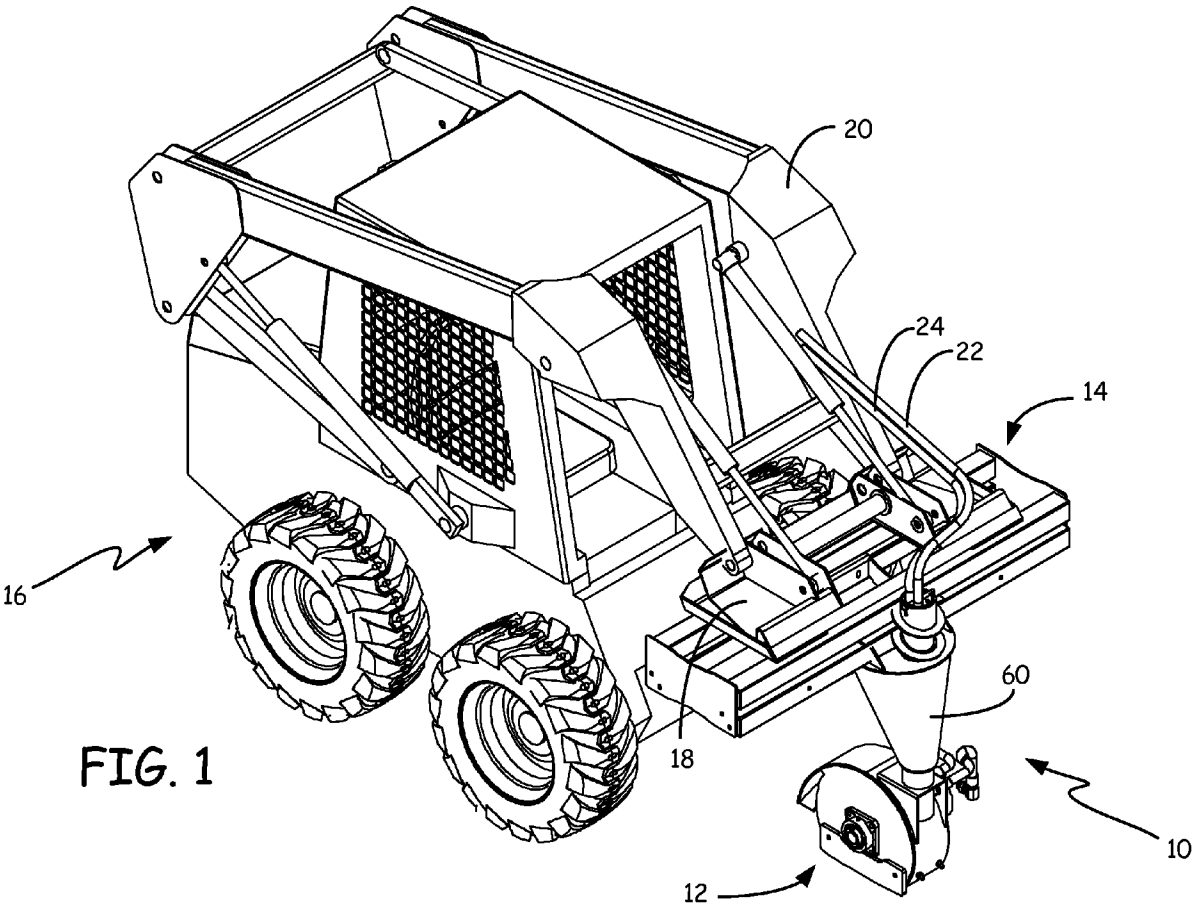
FIG. 1 is a left perspective view of an embodiment of a router cutting apparatus of the present invention attached to a skid steer.
Figure 2:
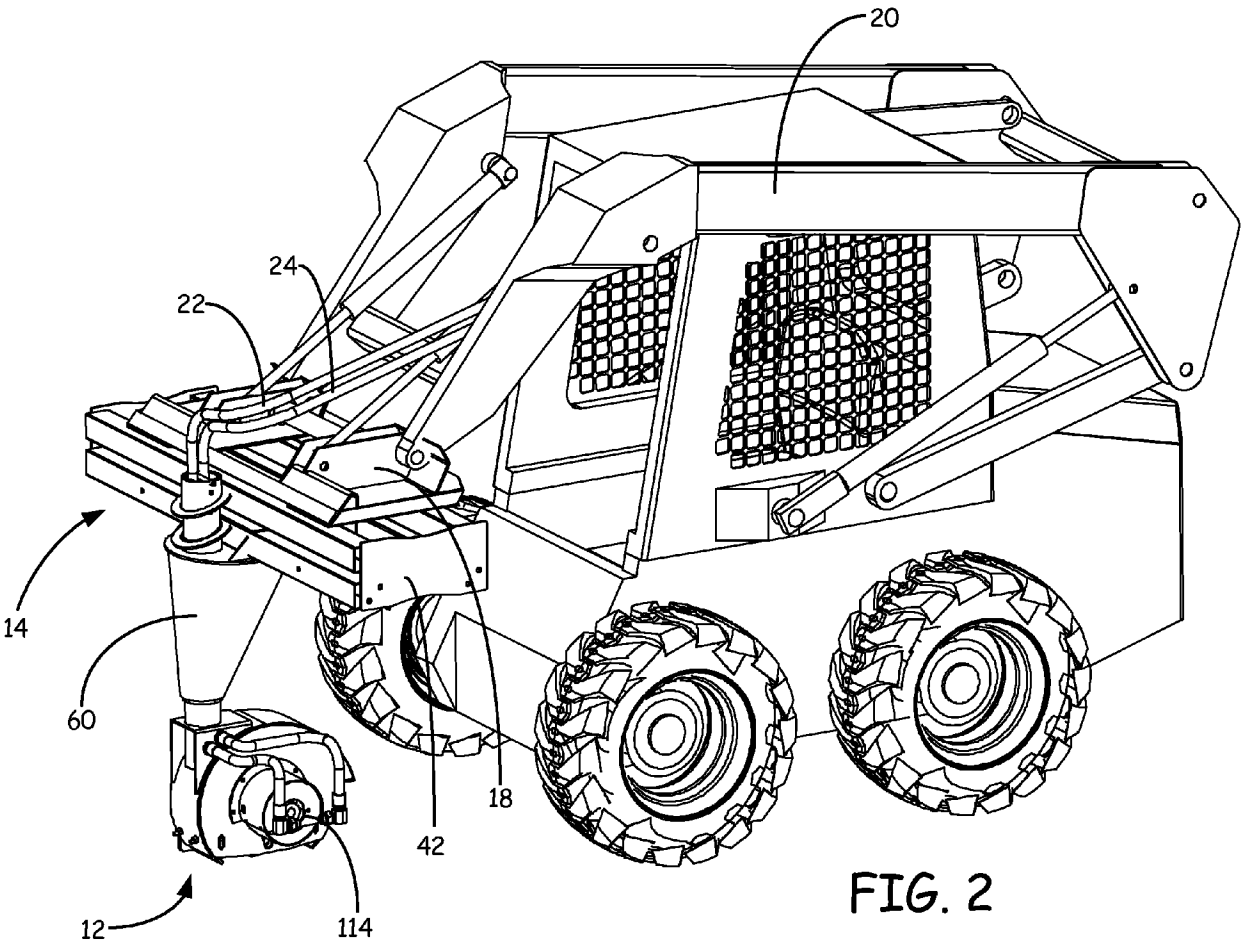
FIG. 2 is a right perspective view of an embodiment of a router cutting apparatus of the invention attached to a skid steer.
Figure 3:
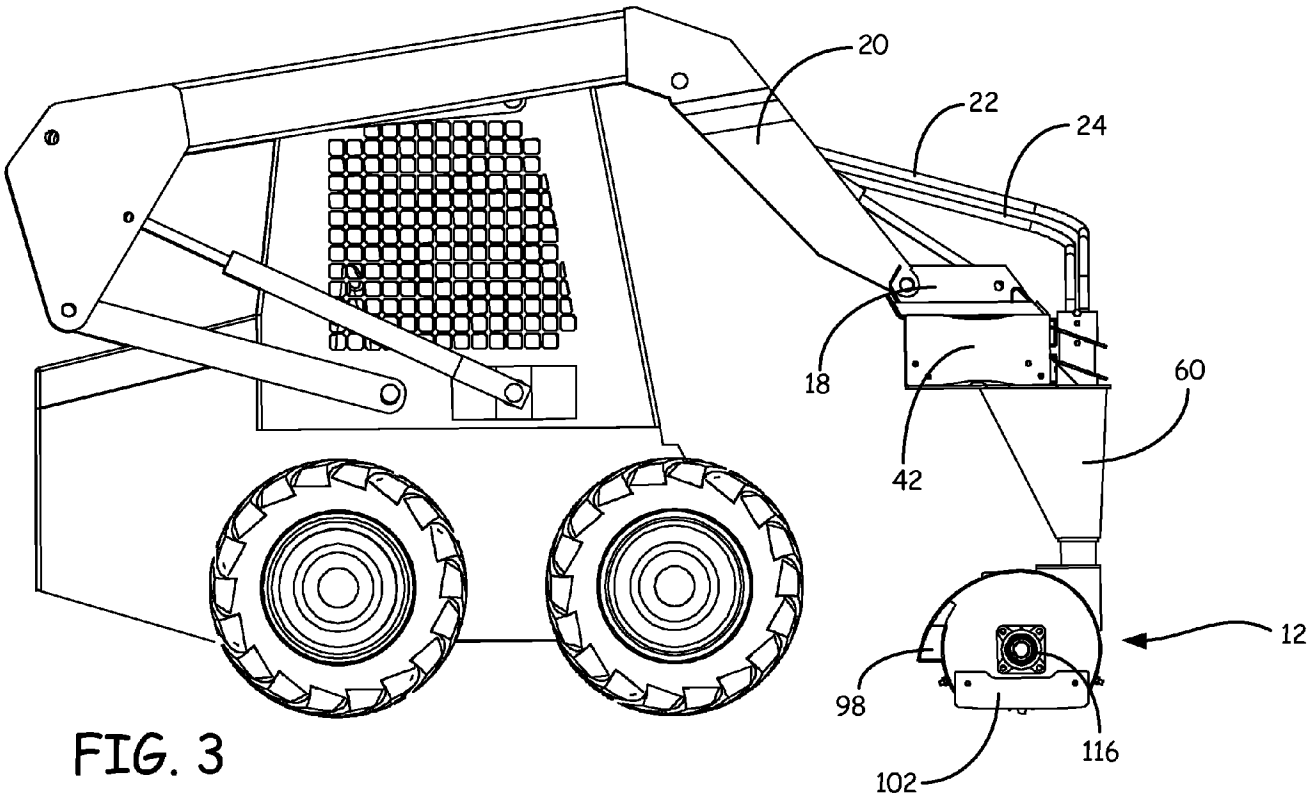
FIG. 3 is a left side view of the router cutting apparatus and skid steer of the type shown in FIG. 1.
Figure 4:
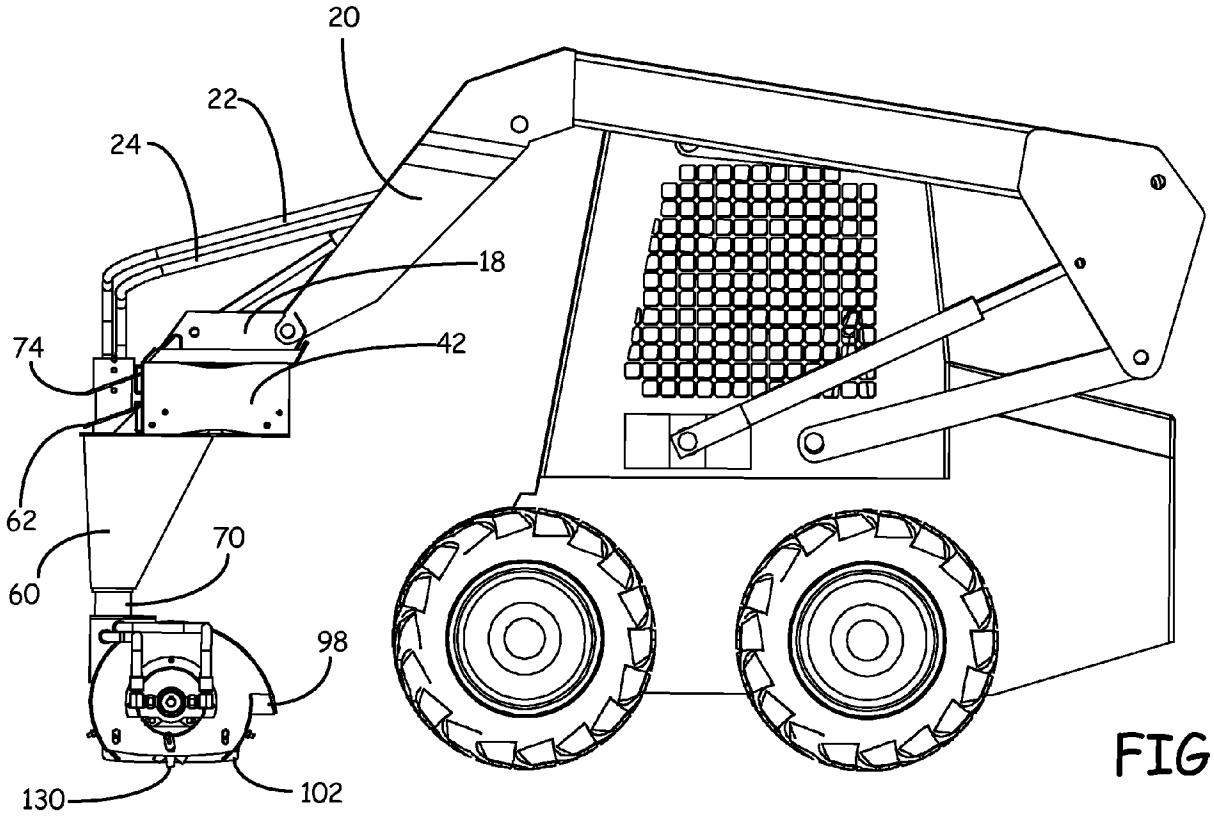
FIG. 4 is a right side view of the router cutting apparatus and skid steer of the type shown in FIG. 2.
Figure 5:
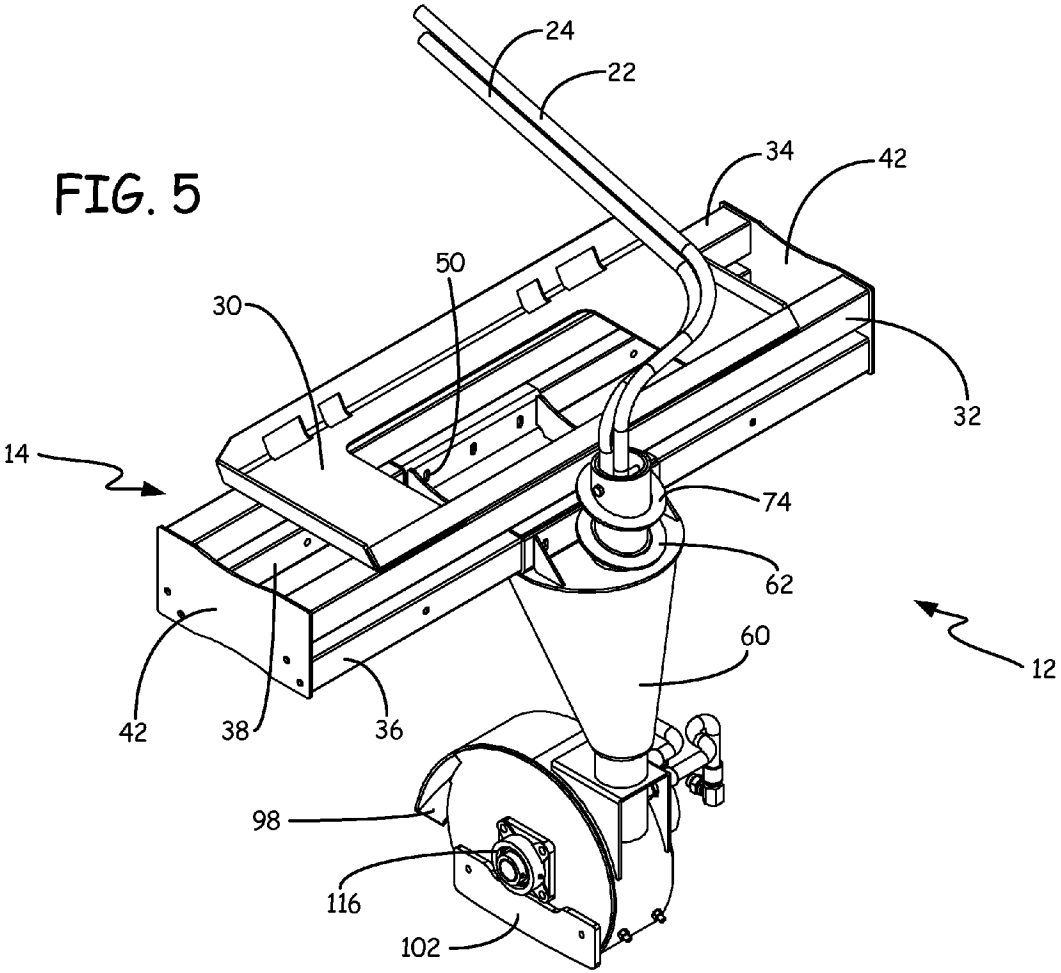
FIG. 5 is a left perspective view of an embodiment of the router cutting apparatus of the present invention.
Figure 6:
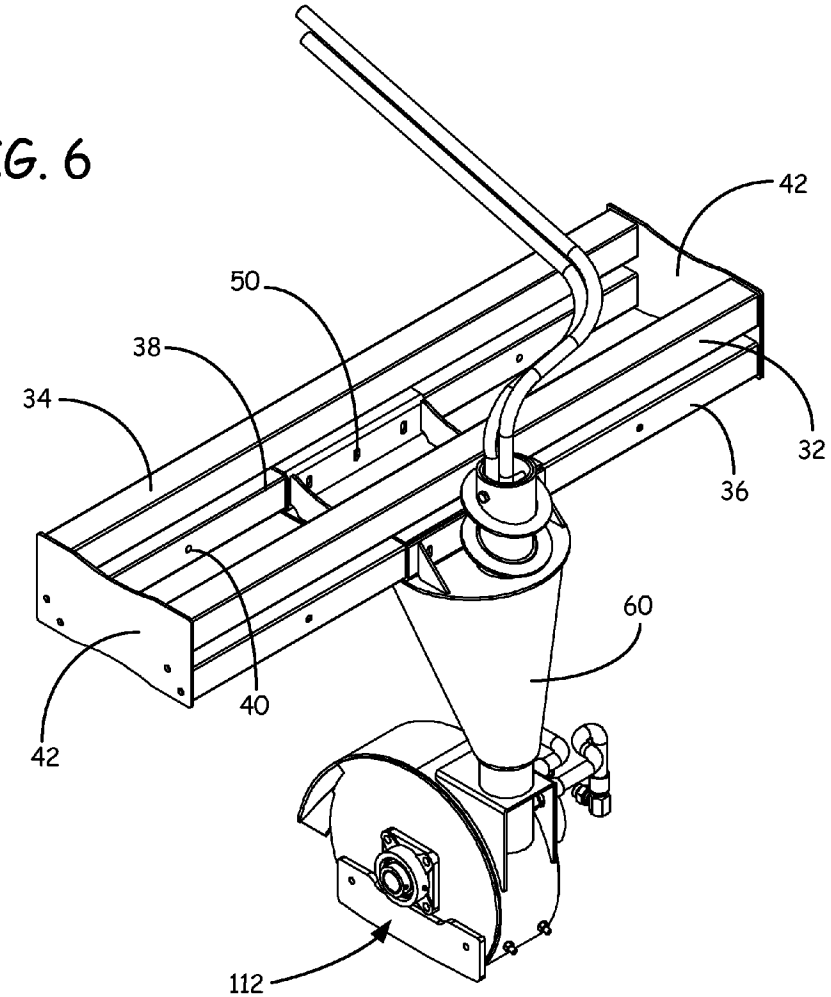
FIG. 6 is a left perspective view of the router cutting apparatus of the type shown in FIG. 5 with the mount frame removed.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus of the present invention is particularly well suited for attachment to a skid steer or other transportation implement. When attached to a skid steer the apparatus includes a frame that allows the cutting system to slide from side to side, slide up and down, or rotate about a vertical axis while cutting. In this manner the cutting system may align itself relative to a crack and uneven pavement as the skid steer moves forward without requiring continuous adjustments from the user. The user may also lock the cutting system in place relative to the frame when desired. The cutting system of the present invention further includes an airflow member that affectively creates an air turbulence to thereby confine the debris and dust within a shroud and direct the debris and dust to a localized exit at a minimized velocity and reduced emissions of airborne particulate.

With reference to the Figures, details of embodiments of the invention will be further discussed. FIGS. 1-4 illustrate the router cutting apparatus 10 of the present invention attached to a skid steer 16. The cutting apparatus 10 generally includes a cutting system 12 and support or frame 14. The skid steer 16 generally includes a universal attachment mounting bracket 18, hydraulic actuated lifting arms 20 and auxiliary hydraulic in and out power lines 22. The actuated lifting arms 20 of the skid steer 16 are of known suitable construction and typically include a first set of hydraulic cylinders that actuate the arms up and down and a second set of cylinders that articulate or rotate the mounting bracket 18 at the end of the arms. Those skilled in the art will appreciate that lift arms 20 may equally be incorporated into other transportation implements including utility vehicles, loaders, tractors, or mini loaders.

Skid steer loader 16 has attachment mount plate 30 of the cutting system 12 coupled to the mounting bracket 18 of the skid steer. The skid steer 16 is shown in the figures having the arms or boom 20 elevated and the mount bracket 18 rotated or extended so that the cutting system 12 is shown in a cutting position adjacent the cutting surface. The arms 20 may lift the cutting system up to elevate the system 12 above the cutting surface. Further, the mount bracket 18 may be rotated towards the cab of the skid steer to align the cutting system in a horizontal position. The cutting system 12 is preferably deactivated when aligned in a position other than vertical. The user may incorporate a shutoff switch into the mount bracket 18 and lift arm 20 so that the auxiliary hydraulics only function when the cutting system is positioned in a relatively vertical position.

FIGS. 5-9 further illustrates the framework for the cutting system. The frame 14 includes the skid attachment mount plate 30 attached to spaced apart upper longitudinal supports 32 and 34. Lower longitudinal supports 36 and 38 are spaced apart and aligned parallel to upper supports 32 and 34. Apertures 40 extend through lower supports 36 and 38 and accept a lock pin (not shown). Side plates 42 attach to ends of the upper longitudinal supports 32, 34 and lower longitudinal supports 36, 38 rigidly retaining the supports in a fixed, spaced relation.

Figure 7:
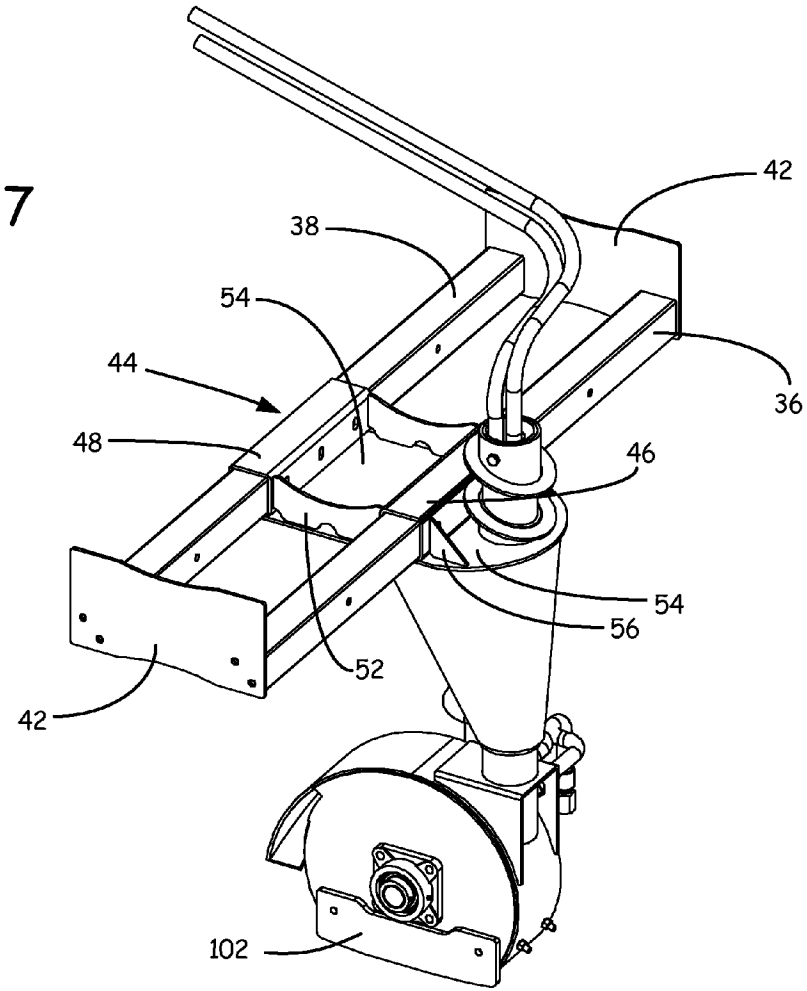
FIG. 7 is a left perspective view of the router cutting apparatus of the type shown in FIG. 6 with upper support frame members removed.
Figure 8:
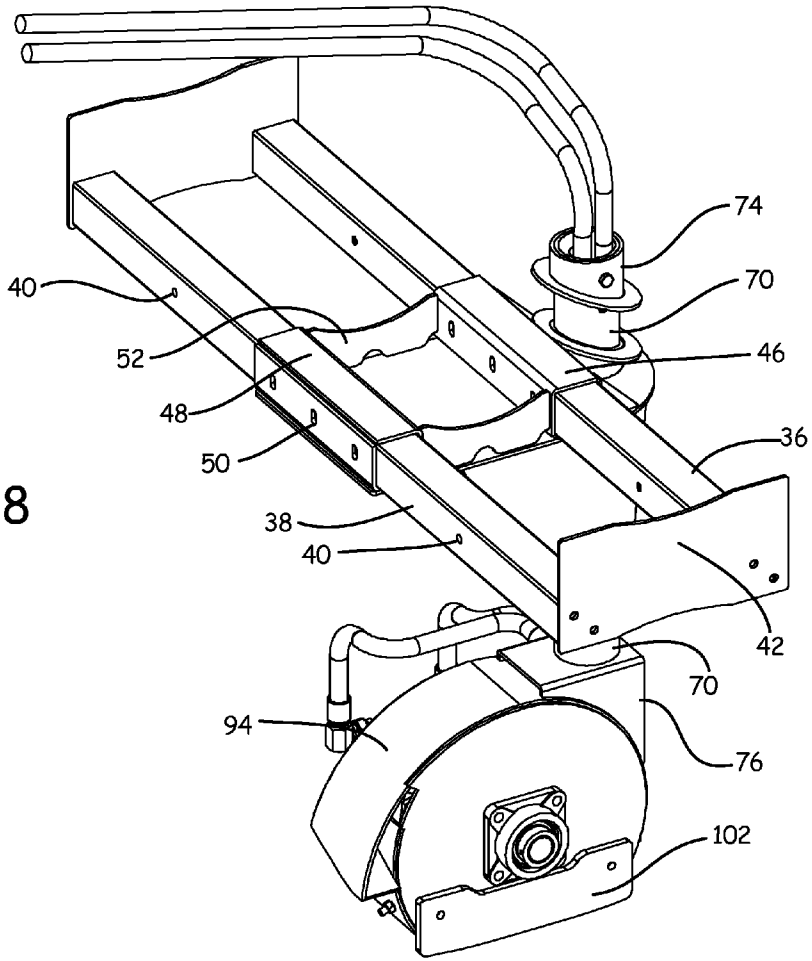
FIG. 8 is a back left perspective view of the router cutting apparatus of the type shown in FIG. 7.
Figure 9:
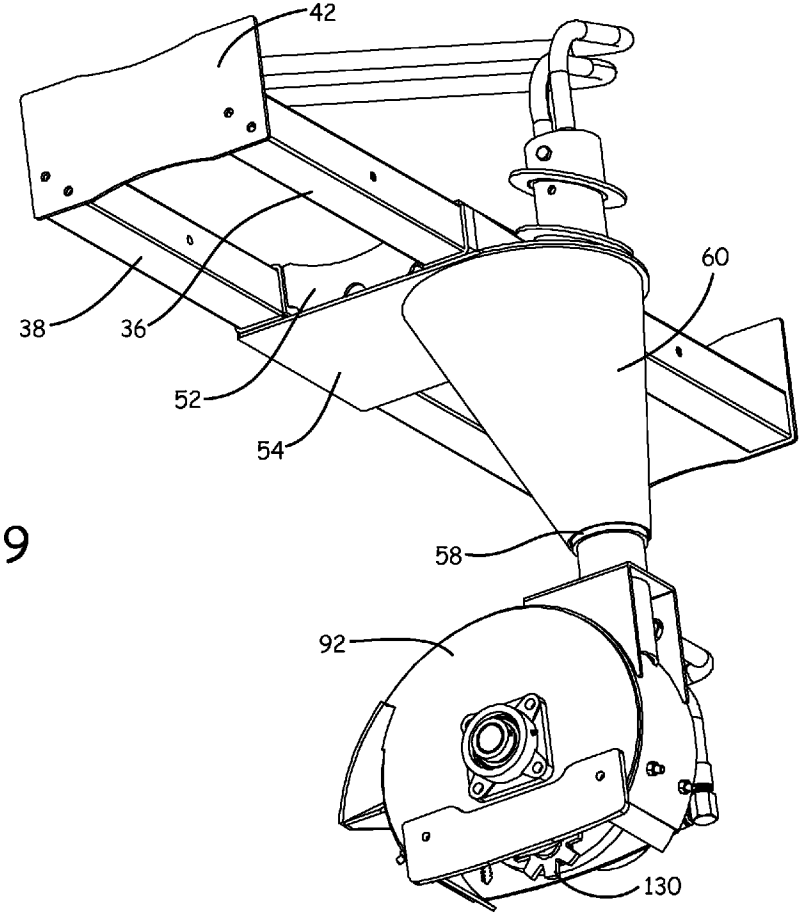
FIG. 9 is a bottom left perspective view of the router cutting apparatus of the type shown in FIG. 7.

Sliding subframe 44 includes longitudinal supports 46, 48 having hollow interiors sized slightly larger than an outer perimeter of corresponding lower supports 36 and 38 (see FIGS. 7-9). The subframe 44 further includes reinforcing side plates 52 that rigidly space the supports 46, 48 parallel with lower supports 36, 38. Attached lower connecting plate 54 and buttresses 56 provide additional rigidity to the sliding subframe 44. Apertures 50 extend through supports 46, 48 and the subframe 44 may be slid along supports 36, 38 until an aperture 50 aligns with an aperture 40. A pin may be slid through the aligned apertures to lock the subframe 44 in place relative to the supports 36, 38, thereby restricting lateral movement of the cutting system 12.

Figure 10:
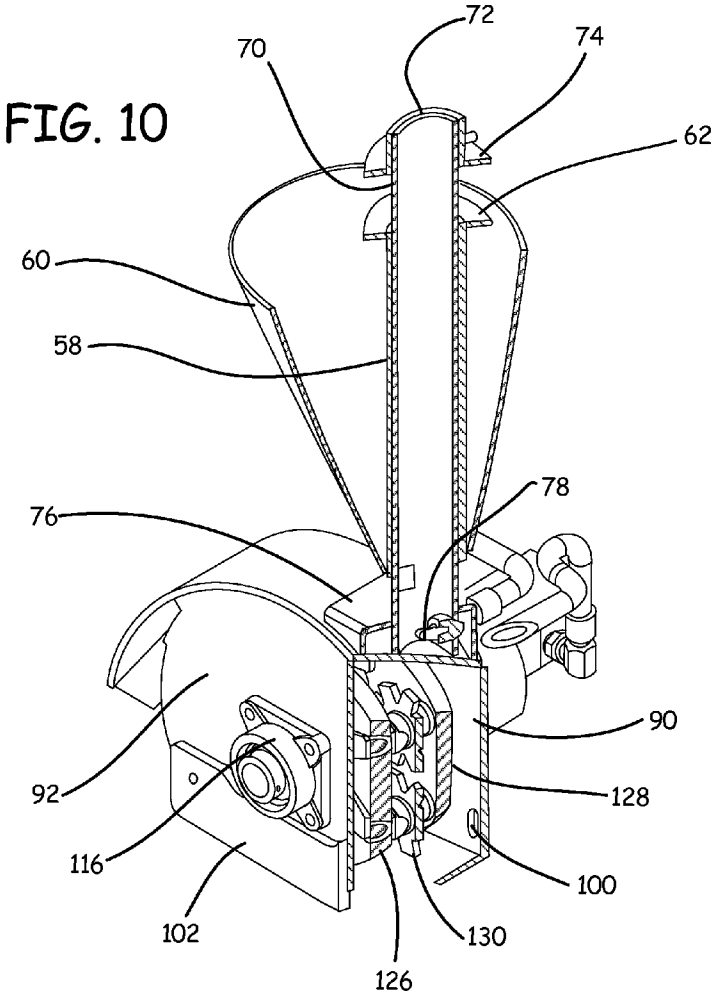
FIG. 10 is a partial sectional top left view of the router cutting apparatus of the present invention with a portion of the frame removed.
Figure 11:
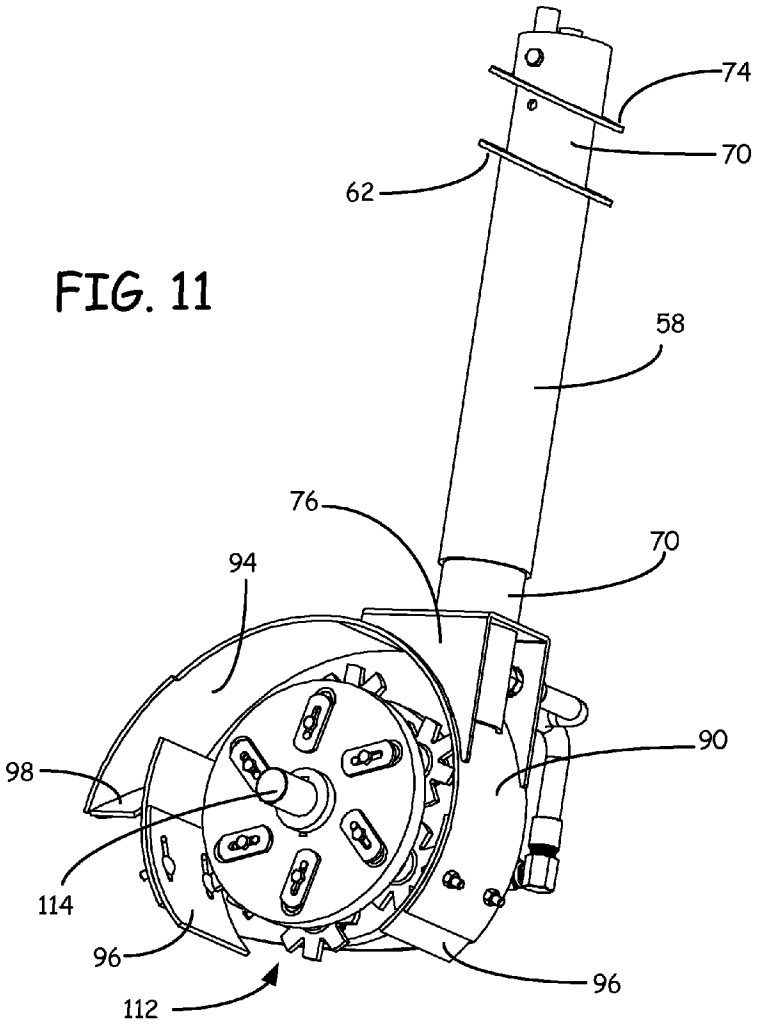
FIG. 11 is a partial sectional perspective view of the portion of the router cutting apparatus of the type shown in FIG. 10 with additional portions of the frame and portions of the shroud removed.
Figure 12:
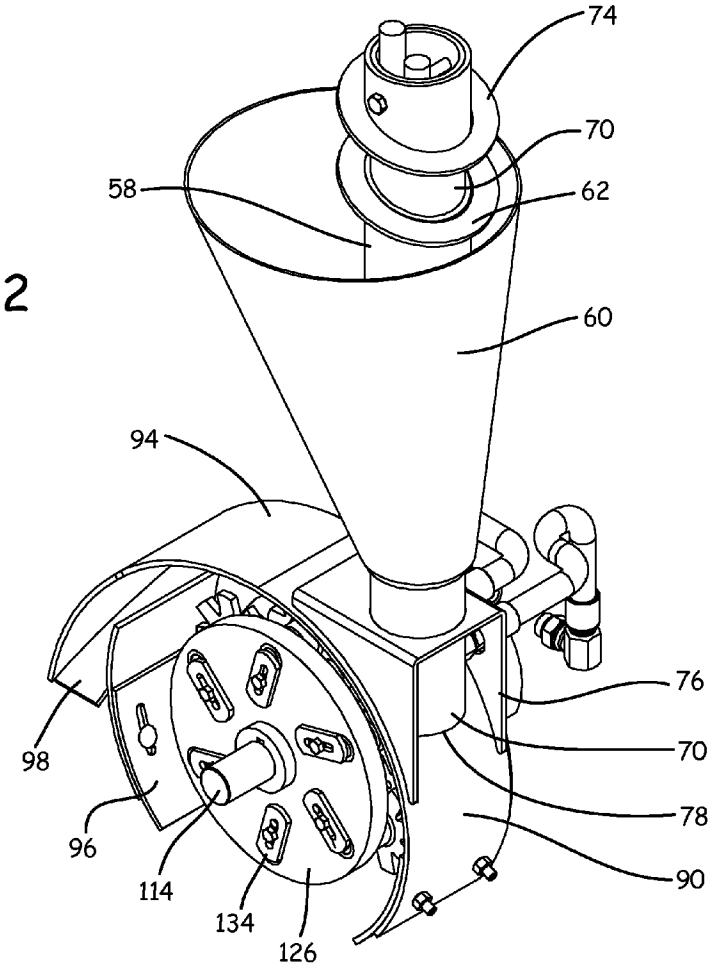
FIG. 12 is a partial sectional top left view of the router cutting apparatus of the type shown in FIG. 10 with a portion of the shroud removed.
Figure 13:
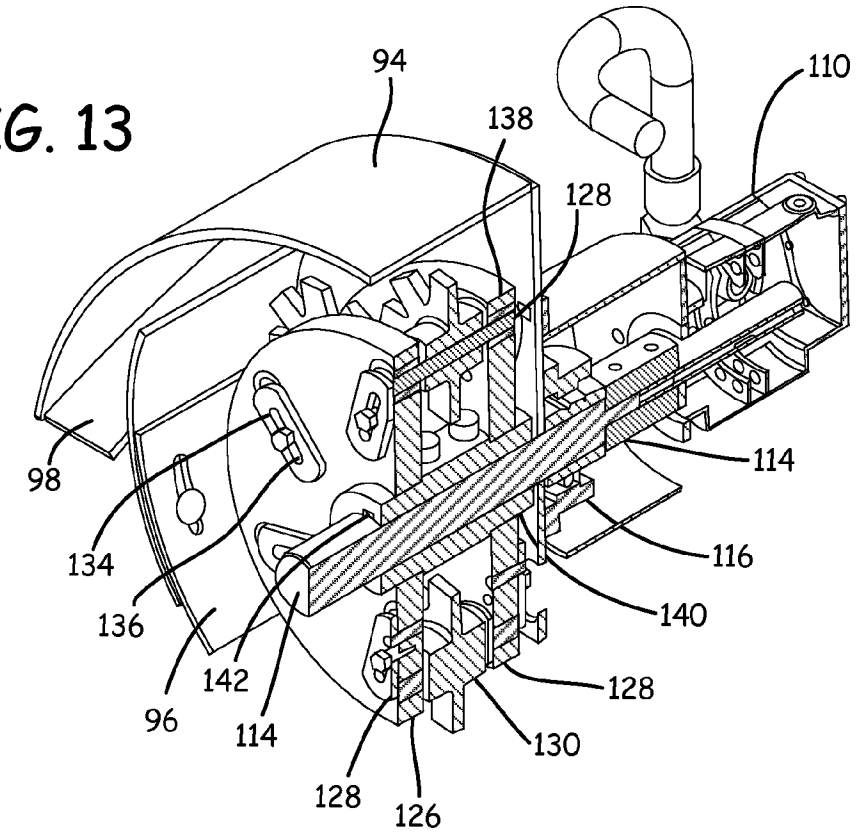
FIG. 13 is a partial sectional perspective view of the cutting system of the present invention with portions of the shroud and assembly removed.
Figure 14:
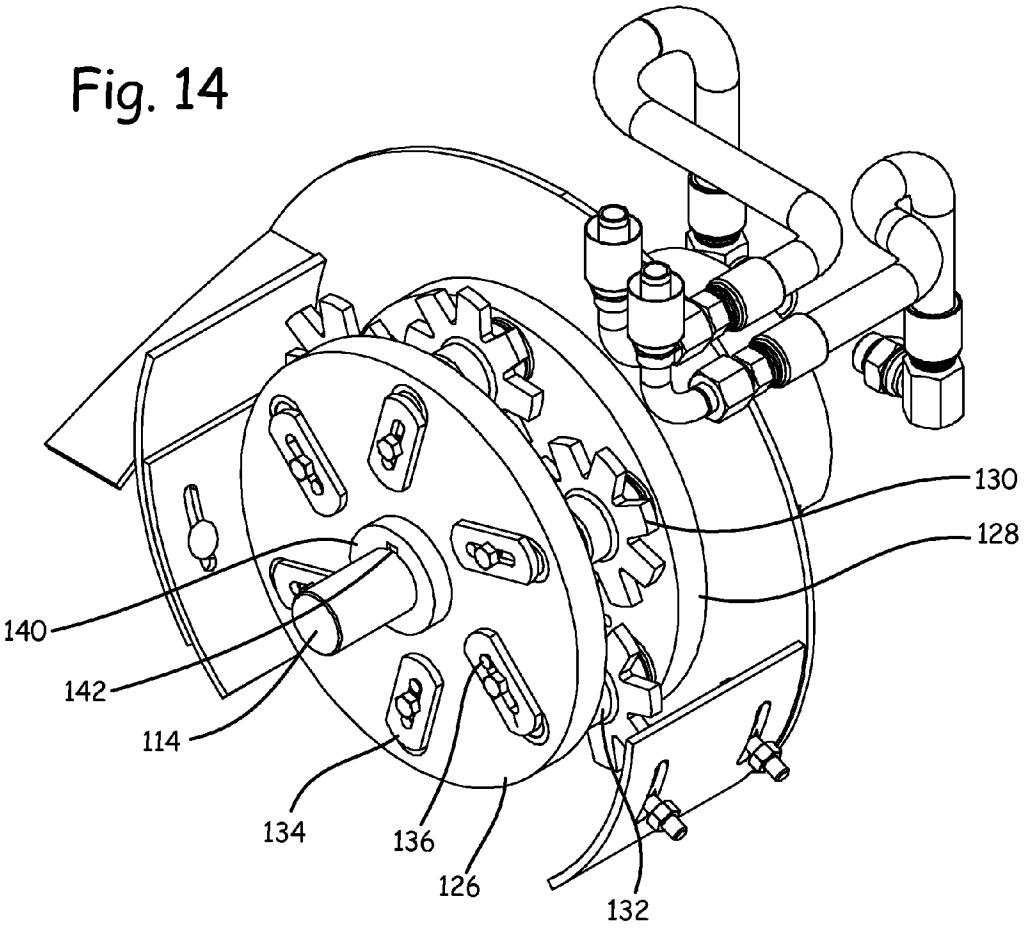
FIG. 14 is a partial sectional top left view of the cutting system of the type shown in FIG. 13 with components removed.
Figure 15:
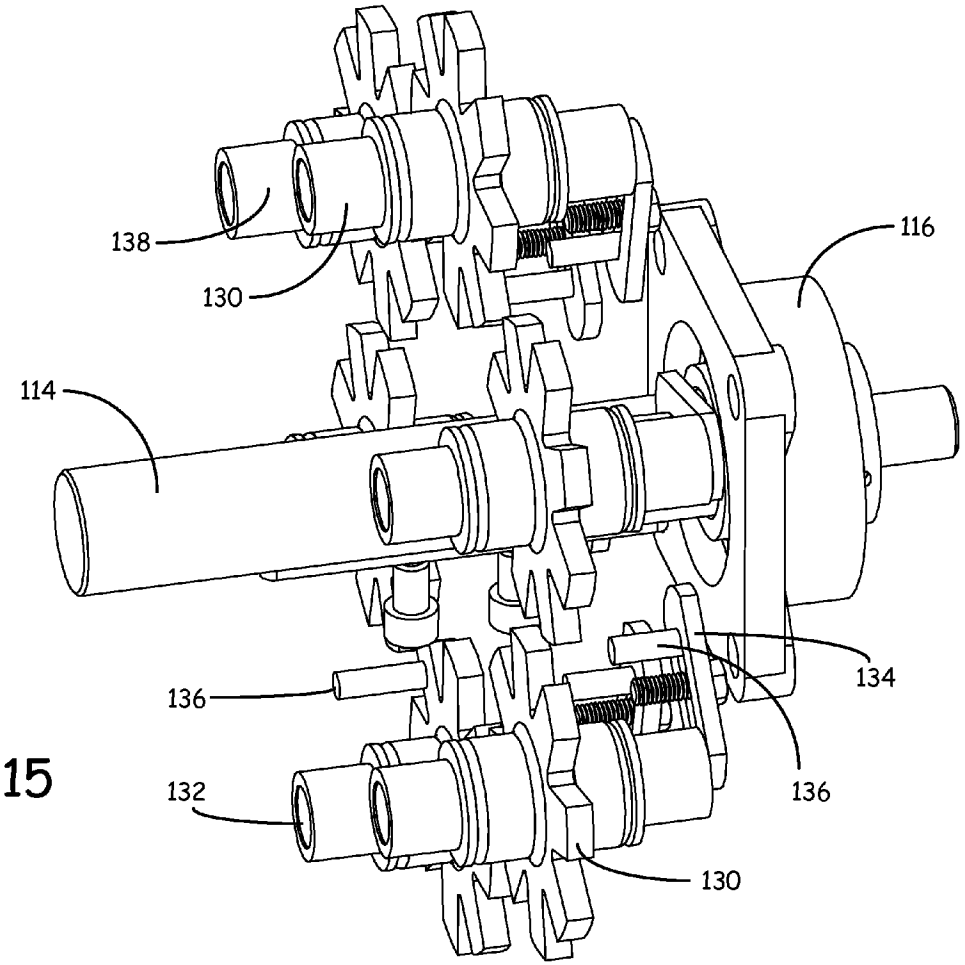
FIG. 15 is a partial sectional front perspective view of a portion of the cutting assembly of the cutting system of the present invention.

The frame 14 also includes outer column 58 and inner column 70 (see FIGS. 10-12). The outer column 58 includes a hollow longitudinal central portion through which the inner column 70 slides. The exterior of the outer column 58 forms an oblique circular cone and an upper end of the outer column 58 supports an underside of the lower connecting plate 54. A travel stop is attached at a sloping angle to the upper end of the outer column 58. Inner column 70 includes a travel stop 74 attached at an angle to a free end 72 of the column. A lower end 78 of the inner column 70 is fixed to a mount bracket 76 and shroud 90. The distance that the inner column slides within the outer column is limited by the difference in lengths of the columns and the travel stops 62 and 74. The inner column 70 may also rotate within column 58. When the rigid portion of the frame, including column 58, is lifted upward the inner column 70 tends to slide downward in the outer column until the travel stop 74 contacts travel stop 62. The angles of the travel stop relative to the vertical axis of the columns tends to rotate the inner column until the travel stops engage each other in a parallel relation. This arrangement provides for a default alignment of the cutting system 12 relative to the frame 14. The column 70 is attached to the cutting system 12 forward of a rotational axis of a cutter assembly 112 and horizontal spindle 114. The vertical alignment of the column 70 and forward offset provides stability to the cutting system and affectively pulls the cutting system 12.

FIGS. 10-15 further illustrates an embodiment of the cutting system 12 of the present invention. The cutting system 12 generally includes a hydraulic motor 110, cutting assembly 112 and a shroud 90. The hydraulic motor 110 rotates a spindle 114 to which the cutter assembly 112 is affixed. Spindle bearings 116 are attached to opposite sides of the shroud 90 and confine the spindle 114 to rotate within the bearings 116. The hydraulic motor, spindle and bearings are all of known suitable design and preferably designed to withstand the impact of the cutter assembly contacting a hard cutting surface.

The shroud 90 includes side plates 92, a top plate 94 to which mount bracket 76 and column 58 are attached, and lower adjustable debris plates 96. Carriage bolts (not shown) extend through carriage alignment apertures 100 and engage to skid plate 102. The skid plate or adjustable cutting depth stop may be raised or lowered and when the carriage bolt is tightened the skid plate is held in a fixed position. In this manner, the height of the skid plate may be adjusted to control the depth that the cutters 130 cut into the cutting surface. The shroud also includes a baffle or chute 98 from which debris is directed and exits.

The cutting assembly 112 includes spaced apart fly wheels 126, 128 that are mounted to a hub or collar 140. The hub engages the spindle and a spindle key 142 fixes the hub 140 to spindle 114. Thus, rotation of the spindle 114 rotates the fly wheels 126 and 128. Multiple cutters 130 are sandwiched concentrically between the fly wheels 126, 128. Each cutter rotates about a spindle or cutter shaft 132 and the shaft 132 is held in place within fly wheel bushings 138. Retainers 134 are bolted to fly wheels 126, 128 thereby retaining the shafts 132 between the flywheels and retaining the assembly 112 together. Pins 136 extend into apertures formed in the fly wheels and are offset from an axis between the shaft 132 and spindle 114. Pins 136 are also engaged to retainers 134 and the offset of the pins results in a length wise axis of the retainers intersecting the axis between the shaft 132 and spindle 114 at an angle.

The retainers 134 extend from an outer surface of the flywheel. The intersecting angle of the retainer may be increased or decreased. The tips of each cutter 130 may include carbide that cuts through hard surfaces with reduced wear. When the rotating cutter assembly contacts a cutting surface each cutter in turn contacts the surface and rotates about its shaft 132. The intermittent contact of the cutters tends to cut and pulverize the hard cutting surface and debris discharges from the cutter tip at relatively high angular velocities. As the flywheels rotate the retainers 134 catch and disturb the air creating turbulence within the shroud 90. The turbulent airflow affectively captures the discharged dust and debris and directs the dust and debris against a leading end of the shroud and lower debris plate 96. The turbulent airflow continues to direct the dust and debris around an interior of the shroud 90 until it exits out the chute 98. The curvature of the chute and interior of the shroud together may form a portion of a logarithmic spiral surface. The continuous contact against the spiraling surface of the shroud slows the velocity of the particulate dust and debris so that upon exit, the dust and debris are directed to the ground at relatively low velocities; reducing the amount of airborne dust particulate. Those skilled in the art will appreciate that the retainers may be further profiled and angled to create a desired turbulent airflow within the shroud.

In use, the skid steer 16 may transport the cutting system 12 to a desired cutting surface. The cutting system is positioned with the columns 58 and aligned relatively vertical to the cutting surface. The user may activate the auxiliary hydraulics to power the motor and turn spindle 114. The cutting assembly in turn rotates and the cutting assembly may be lowered until the cutters contact the cutting surface. As the multiple cutters rotate on independent spindles, the rearward portion of the cutting assembly has a downward travel of corresponding cutters and a forward portion of the cutting assembly has an upward travel of the corresponding cutters. The retaining members generate an air flow and the shroud directs cutting debris behind a downward travel of each cutter. The user may lower the portion of the frame rigidly attached to the skid steer so that the inner column and cutting system 12 floats up and down along an uneven cutting surface. The inner column 70 may rotate about or within the outer column and may further slide linearly up and down relative to said outer column. The floating of the cutting system enables the cutters to align within a crack of a cutting surface and self-align the cutting system. Further, vertical alignment of the column 70 and forward offset from horizontal spindle 114, tends to provide stability to the cutting system and affectively pulls the cutting system 12 through the cutting surface as the user propels the system forward.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An apparatus for cutting hard materials such as concrete or asphalt, the apparatus comprising:

a cutting system including, a motor; a drive spindle extending from the motor; and a cutter assembly coupled to the drive spindle, said cutter assembly having two spaced apart flywheels fixed to said drive spindle and multiple cutters that rotate on independent spindles fixed to said flywheels wherein the multiple cutters are aligned concentric to the drive spindle;

airflow generating members coupled to opposing outer surfaces of said flywheels of said cutting system;

a frame having a rigid portion and a floating portion, said floating portion being coupled to said cutting system and said rigid portion being coupled to a mount that couples said frame to a transport implement;

a shroud surrounding at least a portion of said cutter assembly and attached to said floating portion of said frame, wherein at least a portion of said shroud includes a relatively logarithmic spiral curvature, a surface of said shroud directs cutting debris behind a downward travel of a cutter of said cutter assembly; and said floating portion of said frame including a first column portion and said rigid portion of said frame including a second column portion, wherein said first column portion rotates about said second column portion and further wherein said first column portion slides linearly relative to said second column portion.

2. The apparatus as recited in claim 1, said first column portion further including a self-centering linear travel stop.

3. The apparatus as recited in claim 1, wherein an axis of said floating portion is offset from a rotational axis of said cutter assembly.

4. An apparatus for cutting hard materials such as concrete or asphalt, the apparatus comprising:

a skid loader mount;

a frame having a rigid portion and a floating portion interconnected with said rigid portion, said rigid portion of said frame attached to said mount;

said floating portion of said frame including a first column portion and said rigid portion of said frame including a second column portion, wherein said first column portion rotates about said second column portion and further wherein said first column portion slides linearly relative to said second column portion;

a cutting system attached to said floating portion of said frame, said cutting system including, a motor, a drive spindle extending from the motor, and a cutting assembly coupled to the drive spindle, said cutting assembly having two spaced apart flywheels fixed to said drive spindle and multiple cutters that rotate on independent spindles fixed to said flywheels wherein the multiple cutters are aligned concentric to the drive spindle;

airflow generating members coupled to opposing outer surfaces of said flywheels of said cutting assembly; and a shroud surrounding at least a portion of said cutting assembly to direct cutting debris behind a downward travel of each cutter.

5. The apparatus as recited in claim 4, said first column portion further including a self-centering linear travel stop.

6. The apparatus as recited in claim 5, wherein an axis of said first column portion is offset from a center rotation axis of said drive spindle.

7. The apparatus as recited in claim 4, further including adjustable skid plates mounted to said shroud.

8. The apparatus as recited in claim 4, further including a debris chute extending from said shroud.

9. The apparatus as recited in claim 4, further including an adjustable cutting depth stop coupled to said cutting system.

10. The apparatus as recited in claim 4, wherein at least a portion of said shroud includes a logarithmic spiral curvature.

11. An apparatus for cutting hard materials such as concrete or asphalt, the apparatus comprising:

a frame having a rigid portion, a sub-frame, and a floating portion, said sub-frame engaged in a sliding relation to said rigid portion and said floating portion attached to said sub-frame;

said floating portion of said frame including first and second column portions, said second column portion being attached to said sub-frame, wherein said first column portion rotates about said second column portion and further wherein said first and second columns slides linearly relative to each other;

a cutting system attached to said first column portion of said floating portion of said frame, said cutting system including, a motor, a drive spindle extending from the motor, and a cutting assembly coupled to the drive spindle, said cutting assembly having two spaced apart flywheels fixed to said drive spindle and multiple cutters that rotate on independent spindles fixed to said flywheels wherein the multiple cutters are aligned concentric to the drive spindle.

12. The apparatus as recited in claim 11 further including airflow generating members coupled to opposing outer surfaces of said flywheels of said cutting assembly.

13. The apparatus as recited in claim 12, further including a shroud surrounding at least a portion of said cutting assembly to direct cutting debris behind a downward travel of each cutter.

14. The apparatus as recited in claim 13, further including adjustable skid plates mounted to said shroud.

15. The apparatus as recited in claim 13, further including a debris chute extending from said shroud.

16. The apparatus as recited in claim 13, wherein at least a portion of said shroud includes a logarithmic spiral curvature.

17. The apparatus as recited in claim 11, said first column portion further including a self-centering linear travel stop.

18. The apparatus as recited in claim 17, further including an adjustable cutting depth stop coupled to said cutting system.

19. The apparatus as recited in claim 11, wherein an axis of said first column portion is offset from a center rotation axis of said drive spindle.

* * * * *